US009173537B2

(12) United States Patent
Gerhards

(10) Patent No.: US 9,173,537 B2
(45) Date of Patent: Nov. 3, 2015

(54) VACUUM CLEANER AND METHOD FOR OPERATING A VACUUM CLEANER

(75) Inventor: Manfred Gerhards, Bad-Muenstereifel (DE)

(73) Assignee: MIELE & CIE. KG, Guetersloh (DE)

( * ) Notice: Subject to any disclaimer, the term of this patent is extended or adjusted under 35 U.S.C. 154(b) by 637 days.

(21) Appl. No.: 13/552,814

(22) Filed: Jul. 19, 2012

(65) Prior Publication Data

US 2013/0019901 A1 Jan. 24, 2013

(30) Foreign Application Priority Data

Jul. 21, 2011 (DE) ..... 10 2011 052 020

(51) Int. Cl.
*B08B 3/00* (2006.01)
*A47L 9/28* (2006.01)

(52) U.S. Cl.
CPC ..... *A47L 9/2821* (2013.01); *A47L 9/2842* (2013.01)

(58) Field of Classification Search
None
See application file for complete search history.

(56) References Cited

U.S. PATENT DOCUMENTS

| | | | |
|---|---|---|---|
| 5,033,151 | A | 7/1991 | Kraft et al. |
| 5,155,885 | A | 10/1992 | Jyouraku et al. |
| 6,105,202 | A | 8/2000 | Grasso et al. |
| 2010/0281646 | A1 | 11/2010 | Fujiwara |

FOREIGN PATENT DOCUMENTS

| | | | |
|---|---|---|---|
| DE | 102007025389 | A1 | 12/2008 |
| JP | 2243125 | A | 9/1990 |
| WO | WO 02091899 | A1 | 11/2002 |

*Primary Examiner* — Eric Golightly
(74) *Attorney, Agent, or Firm* — Leydig, Voit & Mayer, Ltd.

(57) ABSTRACT

A vacuum cleaner includes a drive unit configured to generate a volume flow rate and a negative pressure, when energized, during operation of the vacuum cleaner, a means for determining a measure of the volume flow rate generated during operation, a pressure sensor for determining a measure of the negative pressure generated during operation, and a drive unit controller. The drive unit controller is configured to generate an operand from the measure of the determined volume flow rate and the measure of the determined negative pressure, and to compare the operand with a predefinable threshold as a design limit. The drive unit controller is operable to reduce the electrical power input to the drive unit based on the comparison of the operand to the design limit.

5 Claims, 7 Drawing Sheets

VACUUM CLEANER AND METHOD FOR OPERATING A VACUUM CLEANER

CROSS REFERENCE TO RELATED APPLICATIONS

This application claims priority to German Patent Application No. DE 10 2011 052 020.1, filed Jul. 21, 2011, which is hereby incorporated by reference herein in its entirety.

FIELD

The present invention relates to a vacuum cleaner and a method for operating a vacuum cleaner.

BACKGROUND

Vacuum cleaners are generally known and are operated by electric current either from the mains supply or an incorporated power source, namely a storage battery or the like.

Vacuum cleaners draw a relatively high amount of electrical power from the respective power source and convert it into air power or suction power at a floor nozzle or a suction wand. The suction power is the product of the negative pressure and the volume flow rate or volume flow. When vacuuming with the floor nozzle attached, a preferred operating range with good efficiency; i.e., a good ratio of electrical power input to suction power output, is obtained at about half the maximum possible volume flow rate. Frequently, however, the floor nozzle or the end of the suction wand is taken off the floor and set aside, for example, when the user wants to move furniture, to cause the vacuum cleaner to follow him or her, or to go to another room to accept a phone call, or just to interrupt vacuuming for a short time. During such periods, the vacuum cleaner is usually not turned off by the user; rather, it continues to run at the maximum volume flow rate, but without suction power. From an energy point of view, it is particularly disadvantageous that in this condition, maximum power is drawn from the power source, but no suction power is available, and also not needed, at the floor nozzle. In addition to this, the noise typically emitted by a vacuum cleaner continues to be emitted during the entire phase of non-use.

Various proposals have been made to avoid unnecessarily high energy consumption by the suction fan, and further to prevent the noise associated with the operation of the suction fan from being emitted during periods of non-use, or to recognize a condition of non-use.

International Patent Publication WO 02/091899 A describes a method for recognizing a condition in which the vacuum cleaner is not used. The recognition is based on measured pressure values. To this end, provision is made to determine a minimum pressure value and a maximum pressure value from a plurality of successively measured pressure values, and to calculate the difference therebetween. If this difference is below a threshold (i.e., if only small variations in the measured pressure values are sensed during the period in which the pressure values are recorded), it is assumed that the user is currently not using the vacuum cleaner, so that the suction fan motor power is reduced.

The approach of U.S. Pat. No. 6,105,202 is also based on considering a variation of measured pressure values. This patent proposes that, by means of exactly one pressure sensor and predefined rules for processing measured pressure values, a vacuum cleaner that is activated but not in use be prevented from generating undesirably high noise levels and consuming unnecessarily high amounts of energy by reducing the speed of the suction fan when the measured pressure values do not or only slightly change; i.e., when a first time derivative of a series of measured pressure values remains under a threshold.

Japanese Patent Publication JP 2 243 125 A intends to recognize the condition of use by movements of the floor nozzle, and proposes to sense the movement of the floor nozzle using a sensor system that functions as a motion sensor to sense the rotation of a wheel of the floor nozzle. If, in this way, the floor nozzle is detected to be stationary for more than a predefined period of time, this should be usable to turn off the suction fan.

United States Patent Publication US 2010/0 281 646 A describes an operating method for a special type of vacuum cleaner, which is known as upright vacuum cleaner. This method intends to recognize the condition of use using a tilt sensor, so that a larger amount of electrical power is supplied to the suction fan when the appliance is tilted, because this is interpreted to indicate continued use, and that the power supply is reduced when the appliance is in an upright position.

German Patent Publication DE 10 2007 025 389 A describes an operating method for a vacuum cleaner, which aims at uniform noise generation. To this end, a controller controls the volume flow rate generated by the suction fan as a controlled variable. In this connection, however, it is not necessary to measure the volume flow rate generated at any one time and, therefore, the volume flow rate is not known. Instead, it is possible to use experimental data, according to which the volume flow rate depends on the particular floor covering. For example, for smooth floor surfaces it is higher than for carpeted floors. On this basis, it is sufficient to transmit information on the respective floor covering to the controller, so that a floor covering sensor may be used in place of a volume flow rate sensor, which is not needed here.

In German Patent Publication DE 689 16 607 T, a method for operating a vacuum cleaner is described in which the static pressure generated by the suction fan at any one time is measured by exactly one pressure sensor. When the measured static pressure increases, the suction fan power is increased. The increase of the suction fan power is canceled when the measured static pressure falls below a threshold. In order to prevent oscillations, German Patent Publication DE 689 16 607 T proposes that the threshold at which the increase of the suction fan power is canceled be below the threshold at which the increase of the suction power was previously initiated.

SUMMARY

In an embodiment, the present invention provides a vacuum cleaner including a drive unit configured to generate a volume flow rate and a negative pressure, when energized, during operation of the vacuum cleaner, a means for determining a measure of the volume flow rate generated during operation, a pressure sensor for determining a measure of the negative pressure generated during operation, and a drive unit controller. The drive unit controller is configured to generate an operand from the measure of the determined volume flow rate and the measure of the determined negative pressure, and to compare the operand with a predefinable threshold as a design limit. The drive unit controller is operable to reduce the electrical power input to the drive unit based on the comparison of the operand to the design limit.

BRIEF DESCRIPTION OF THE DRAWINGS

Exemplary embodiments of the present invention will be described in more detail below with reference to the drawings. Corresponding objects or elements are identified by the same reference numerals in all figures. It is understood that neither this nor any other exemplary embodiment should be construed as limiting the scope of the present invention. Rather, within the framework of the present disclosure, numerous revisions and modifications are possible, which, for example, by combining or altering individual features or elements or method steps described in connection with the general description and the, or each, particular embodiment, as well as the claims, and contained in the drawings, may be inferred by one skilled in the art with regard to achieving the objective, and lead, through combinable features, to a new subject matter or to new method steps or sequences of method steps.

In the drawings.

DETAILED DESCRIPTION

Figure 1:
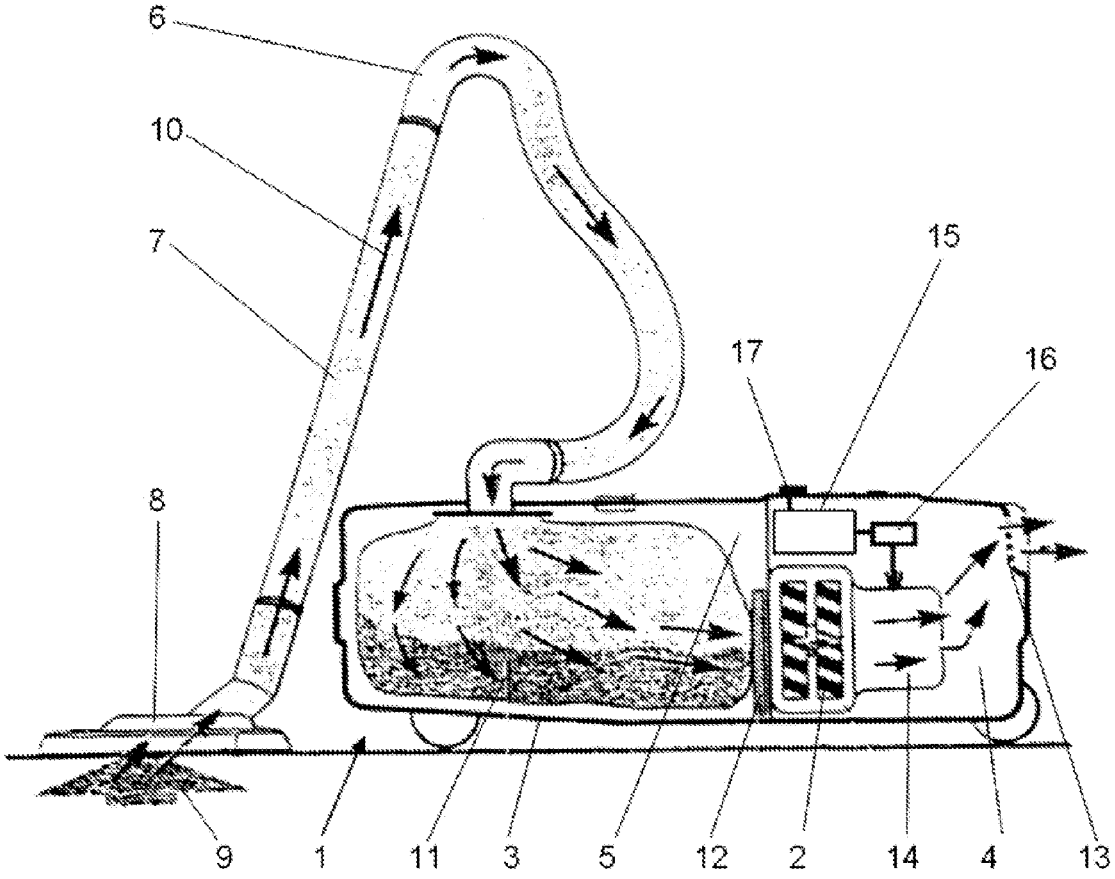
Fig. 1 Prior Art
FIG. 1 shows a canister vacuum cleaner of a kind known per se, which is designed as a canister vacuum cleaner.

In an embodiment, the present invention provides a vacuum cleaner and a method for operating a vacuum cleaner, in which a condition of non-use is reliably recognized, so that unnecessarily high energy consumption by the drive unit of the suction fan is avoided, and further the noise associated with the operation of the suction fan is prevented from being emitted during periods of non-use.

In an embodiment, the present invention provides a vacuum cleaner having a drive unit and a drive unit controller, said drive unit, when energized, generating a volume flow rate and a negative pressure during the operation of the vacuum cleaner, first of all, provision is made for the vacuum cleaner to include means for determining a measure of the volume flow rate generated during operation, as well as means for determining a measure of the negative pressure generated during operation. Without loss of generality, the phrase "for determining a measure" in connection with the determination of a measure of a particular quantity may sometimes be omitted hereinafter for the sake of better readability. It is obvious to those skilled in the art that equivalent solutions can be obtained when a particular quantity cannot be determined directly, but a measure of the respective quantity is determinable, and this measure is used instead of the respective quantity. A measure of a volume flow rate generated during operation, or a measure of a negative pressure generated during operation, is, for example, a respective proportional or inversely proportional electric current or electric voltage. In very general terms, the determination of a measure of a particular quantity includes determining a respective measured value and generating and/or relaying a corresponding signal.

Along these lines, this phrase may hereinafter sometimes also be omitted for other quantities under consideration, and the vacuum cleaner can further be characterized in that its drive unit controller includes means for generating an operand from the determined volume flow rate and the determined negative pressure, optional means for comparing the determined volume flow rate to a predefined or predefinable upper flow rate limit, and in any case means for comparing the operand to a threshold predefined or predefinable as a design limit. By comparing the volume flow rate to the upper flow rate limit, it is possible to recognize a condition in which the floor nozzle is taken off the floor, since the volume flow rate increases significantly in this condition. A floor nozzle taken off the floor is an indicator of a condition of non-use, because, for example, when the suction wand is laid down, the floor nozzle is also completely or partially lifted off the floor. By comparing the operand to the design limit it is possible to reliably recognize a lifted state of the floor nozzle. In addition, when the volume flow rate and the operand are considered in parallel, it is possible to prevent interpretation errors which may occur, for example, when the increased volume flow rate is due to a new, empty vacuum bag. The operand may be based on, for example, a ratio of the volume flow rate to the negative pressure, in particular a quotient of the volume flow rate and the negative pressure, as well as a corresponding signal, or a quotient of the square of the volume flow rate and the negative pressure (any ratio of the volume flow rate to the negative pressure and, in particular, any quotient calculated from the volume flow rate and the negative pressure is to some extent also a measure of the suction power, because the suction power is calculated as the product of the volume flow rate and the negative pressure), so that the operand alone is meaningful with respect to an increased volume flow rate and its cause, namely the lifting of the floor nozzle off the floor. This is because the operand generated, for example, as a quotient or other ratio of the volume flow rate and the negative pressure increases significantly when the maximum volume flow rate for the respective filling level of the dust bag/dust collection container of the vacuum cleaner is reached. The operand may be generated using any qualified calculation algorithm that uses, as input variables, a measure of the volume flow rate q and a measure of the negative pressure h. An algorithm based on $q*q/h$ was found to work particularly well for generating a limit value.

Thus, the drive unit controller finally also includes means for reducing the electrical power input to the drive unit depending on both the result of the comparison of the volume flow rate to the upper flow rate limit and on the result of the comparison of the operand to the design limit. Alternatively, the drive unit controller may itself not include, but drive the means for reducing the electrical power input to the drive unit.

In European Patent Publication EP 0373 353 A, an air turbine is driven by the exhaust air stream of a suction fan, and the rotational speed of the air turbine is measured. The air turbine functions as a volume flow rate sensor, and the intention is to be able to determine operating conditions of the vacuum cleaner, such as, for example, the filling level of the dust bag, based on a measured value provided by this volume flow rate sensor. European Patent Publication EP 0373 353 A also mentions the possibility of combining measured flow rate values provided by the air turbine with measured values of a diaphragm pressure switch in order to be able to recognize operating conditions that would not be clearly identifiable based on a measured flow rate value alone.

However, EP 0373 353 A makes no mention of determining the suction power, and does not perform a combined comparison of the volume flow rate and the suction power to respective comparison values. Furthermore, in EP 0373 353 A, no provision is made to reduce the power input to the drive unit; but rather provision is made to drive an operating condition indicator to indicate, for example, the filling level of the dust bag.

An advantage of the present invention is that the parameters that are relevant for determining the suction power are determined directly by determining a measure of the volume flow rate and a measure of the negative pressure, so that the suction power, or at least a measure of the suction power, is measured, respectively determined, indirectly based on a direct measurement of the respective relevant parameters. Based on the measure of the suction power, which is determined in the form of an operand, the condition of use may be recognized in a simple and reliable way and, specifically, a condition of non-use can be easily recognized because in a condition of non-use, the suction power drops instantly and dramatically until it finally disappears. A further advantage of the present invention is that, through the improved recognition of the condition of non-use ensured in this manner, an automatic stop function or, in refined embodiments, even an automatic start/stop is achieved for the vacuum cleaner, which reduces the power input when the electrical power is actually not needed. Accordingly, the approach proposed herein is also referred to in short as "start/stop function" hereinbelow. Furthermore, without loss of generality, the reduction of the power input to the drive unit is also referred to in short as "turning-off" of the drive unit, even though such a turning off may not mean a complete, but only a partial reduction of the power input. Such a turning off of the vacuum cleaner always involves that the noise typically emitted by the vacuum cleaner stops or is at least reduced.

In an embodiment of the vacuum cleaner, the drive unit controller includes means for determining a duration during which the determined volume flow rate exceeds the upper flow rate limit, and means for comparing the duration of the exceedance to a predefined or predefinable time limit, and, as a means for reducing the electrical power input, a signal output that can be activated depending on the result of the comparison of the determined duration and the time limit. In this manner, it is achieved that the stop function is actually activated only when the condition for its activation is met for a certain period of time, so that not each brief lifting of the floor nozzle, and the associated brief increase in the volume flow rate, will lead to an unwanted turning off of the drive unit. According to the inventor's findings, suitable values for the time limit are on the order of from 50 ms to 200 ms.

Thus, in this embodiment, the determined volume flow rate is compared to the upper flow rate limit, and if the upper flow rate limit is exceeded for a period of time determined by the time limit, the signal output of the drive unit controller can be activated. In reality, however, the signal output is activated only when, in addition, the operand value generated based on the measured values of the negative pressure and the volume flow rate also exceeds the design limit. Alternatively, it is also conceivable to provide only the operand; i.e., for example, the quotient of the volume flow rate and the negative pressure, and the design limit for the activation of the stop function, possibly taking into account a time limit. Regardless of the specific embodiment, the design limit makes it possible to take into account the resistances of the dust bag and the motor and exhaust filters on the one hand, and the current power setting for the drive unit on the other hand.

In another embodiment, the vacuum cleaner has a combination function, such as, for example, an AND gate or the like, as a means for combining the result of the comparison of the determined duration and the time limit on the one hand, and the result of the comparison of the operand and the design limit on the other hand; an output of this combination function representing the activatable signal output. The activatable signal output may then be connected to an actuator for reducing the power input to the drive unit, and thus cause the "turning off" of the drive unit in the sense explained above.

The "turning off" of the drive unit can be canceled when the operating condition changes, for example, when the lifted floor nozzle is put down and the user continues vacuuming. This is accomplished in that a caused reduction of the power input to the drive unit is detected as a condition of the vacuum cleaner, and in that the reduction of the electrical power input to the drive unit is canceled when the volume flow rate decreases and/or the negative pressure increases during such a condition. Thus, the user is provided with a fully automatic start/stop function, namely an automatic "turning off" (stop function) on the one hand, and an automatic restarting of the drive unit (start function) on the other hand. The detection of a decrease in the volume flow rate or an increase in the negative pressure, or of a decrease in the volume flow rate and a simultaneous increase in the negative pressure, are explicitly independent and at least substantially equivalent criteria for the automatic restarting of the drive unit. If the negative pressure is exclusively or additionally considered, it is possible, in particular, to sum up sensed pressure changes and to derive a signal to reactivate the drive unit when the so-obtained sum exceeds a threshold.

By energizing the drive unit, at least briefly, with a particular maximum allowable motor voltage during restarting; i.e., in connection with the cancellation of the reduction of the electrical power input to the drive unit, the vacuum cleaner can be more quickly restored to the operating condition which existed prior to the automatic deactivation and which corresponds to the power setting.

If the duration of the brief energization of the drive unit with the respective maximum allowable motor voltage is a function of a power setting selected for the drive unit, then this results in a dynamic restarting of the drive unit according to the operating condition which existed prior to the automatic deactivation and which is to be restored.

If in a condition of a caused reduction of the power input to the drive unit, the duration of this condition is monitored, and if the drive unit is deactivated when the duration exceeds a predefined or predefinable threshold, then the automatic stop function or the automatic start/stop function is suitably enhanced to the effect that, first, the power input is reduced, but not yet to zero, by, as it were, a level-one stop function, and that the reduction of the power input to zero; i.e., the actual turning off of the drive unit, is effected only if, during a specific period of time, the drive unit is not activated by resuming the use of the vacuum cleaner (level-two stop function). It may be provided that a turned-off drive unit can only be re-activated by a user action, such as, for example, pressing a button or the like, or by a movement of the floor nozzle that is detectable by a motion sensor. This permits complete turning off not only of the drive unit, but also of the driving electronics, thereby allowing the energy consumption of the vacuum cleaner to be reduced to zero, or nearly so. According to the inventor's findings, suitable values for the threshold are on the order of about thirty seconds.

In an embodiment, the present invention also provides a vacuum cleaner that operates in accordance with the method as described here and below and, to this end, includes means for implementing the method. Preferably, the present invention is at least partially implemented in software or in software and firmware/hardware. Thus, the present invention is, firstly, also a computer program including program code instructions executable by a computer, and secondly, a memory medium containing such a computer program, and finally also a control unit in the form of a drive unit controller, or including such a drive unit controller, or a vacuum cleaner including such a control unit into whose memory such a computer program is loaded or loadable as a means for implementing the method and embodiments thereof.

Thus, an advantage of the present invention and embodiments thereof is as follows: While the vacuum cleaner is operated in a condition in which, for example, the floor nozzle is lifted off the carpet or floor covering and no cleaning action occurs, or during other short vacuuming breaks, the electrical power input can be reduced for a short period of time, and be dynamically restored without the user having to accept constraints on the suction power or to perform additional actions. The input power drawn from the mains is greatest (P1=max) when, during operation, the floor nozzle is taken off the carpet (open aperture), although in this condition no suction power can be generated (in this condition, generation of a negative pressure by the drive unit is hardly possible, the negative pressure h tends to zero, and consequently the suction power P2 also tends to zero. These conditions have heretofore been accepted. In view of increased energy costs and a mind shift towards ecological consciousness, it is useful to provide an intelligent control system that allows the electrical power input to be dramatically reduced according to the condition of use, and to be automatically restored without imposing any restrictions on the user or impairing the vacuuming result. In addition, using the approach proposed herein, it is possible not only to minimize the electrical power input during times when vacuuming is not carried out within the predefined operating range, but also to minimize, or at least reduce, the noise typically associated with the operation of a vacuum cleaner, so that a beneficial acoustic effect is also obtained. The noise is generated due to the lack of sound insulation of the floor nozzle on the floor and, to an even greater degree, to the maximum volume flow rate and the resulting maximum air velocity. With regard to the dynamics, it has turned out to be advantageous to provide a time interval of from 50 ms to 200 ms for the power reduction (automatic stop function) and a time interval between 20 ms and 100 m for the restoring process.

FIG. 1 shows, in simplified schematic form, a vacuum cleaner 1 designed as a canister vacuum cleaner. In principle, however, the present invention is suitable for any vacuum cleaner 1 that is equipped with a fan unit having a motor-driven suction fan 2 as a drive unit. The vacuum cleaner 1 shown includes a housing 3, which is divided into a fan chamber 4 and a dust collection chamber 5. In fan chamber 4, suction fan 2 is arranged with its suction side facing dust collection chamber 5 where it generates a negative pressure which is delivered through a connected suction hose 6 and a suction wand 7 to the suction opening of a floor nozzle 8. Thus, dirt-laden air 9 (represented by arrows 10) is drawn in (suction air stream) from the surface being worked on and is cleaned by dust separators. In this exemplary embodiment, said dust separators are a dust bag 11 and a downstream motor filter 12. The cleaned air is then discharged into the environment through an exhaust filter unit 13. A fan motor 14 of suction fan 2 is controlled in a manner known per se by control electronics of a control unit 15 for controlling, for example, power semiconductor devices of an inverter 16. Control unit 15 is an example of a drive unit controller or includes such a drive unit controller. During operation of vacuum cleaner 1, fan motor 14 of suction fan 2 is supplied with electrical power in a manner known per se. Thus, suction fan 2 generates a negative pressure and, finally, a volume flow rate as a basis for the suction air stream. A control and display unit 17 is provided for user control and information purposes.

Various devices are suitable for use as the means for determining a measure of a volume flow rate (symbol q) generated during operation, in particular, for determining analog values of the actual volume flow rate q. For example, it is possible to use in particular an analog differential pressure sensor placed in the immediate vicinity of suction fan 2, for example, in the area of a motor protection grill usually provided there. The measured differential pressure between the static/dynamic pressure drop (Pitot probe) correlates very well to the volume flow rate q in the considered measurement range. Alternatively, for example, a hot wire, a pressure connection at suction fan 2, or the derivation of the volume flow rate q from the characteristic curves of the motor could be conceived of and implemented. A suitable location for measuring the volume flow rate is, in particular, also the central mounting of the suction fan or a rubber seal of the suction fan, because the flow velocities are highest there. It is also possible here to incorporate a suitable sensor system into the central mounting/rubber seal, for example, by injection molding.

A suitable means that may be used in vacuum cleaner 1 to determine a measure of a negative pressure (symbol h) generated during operation is a pressure sensor, in particular, an analog pressure sensor, placed in the area of the inlet of vacuum cleaner 1 as a differential pressure sensor against the ambient pressure to measure the pressure in suction hose 6 or at the inlet of dust bag 11. The negative pressure measured there may then be compensated by the flow-rate-dependent pressure drop in suction hose 6 in order to ensure constant suction power at the end of suction hose 6. This could be omitted if the pressure were measured locally in floor nozzle 8, but additional wiring to floor nozzle 8 would be required.

In order to process a measure of the volume flow rate; i.e., for example, a measured flow rate value 20, drive unit controller 21 (shown in FIG. 2 as a functional unit of control unit 15) has a comparator 22 as a means for comparing measured flow rate value 20 to a predefined or predefinable upper flow rate limit stored, for example, in a memory 23. Depending on the result of the comparison performed by comparator 22, inverter 16, as an actuator for the drive unit, is driven by generating a corresponding signal via an activatable signal output 24 as a means for reducing the electrical power input to suction fan 2 (drive unit).

Alternatively or in addition, in order to process a measure of the negative pressure; i.e., for example, a measured negative pressure value 25, drive unit controller 21 (shown in FIG. 2 as a functional unit of control unit 15) has a comparator equivalent to the above-mentioned comparator 22 as a means for comparing measured negative pressure value 25 to a predefined or predefinable lower limit for the negative pressure, which is stored, for example, in a memory 23. Depending on the result of the comparison performed by the comparator, inverter 16, as an actuator for the drive unit, is driven by generating a corresponding signal via an activatable signal output 24 as a means for reducing the electrical power input to suction fan 2 (drive unit).

The present invention and embodiments thereof may be implemented in particular in software or firmware, so that, for example, comparator 22 is implemented as a software or firmware function in a control program 30 (FIG. 3) in memory 23 of drive unit controller 21. Without loss of generality, the description is continued assuming that the implementation is in software, although an implementation in hardware or a combination of software and hardware may be used alternatively.

Figure 3:
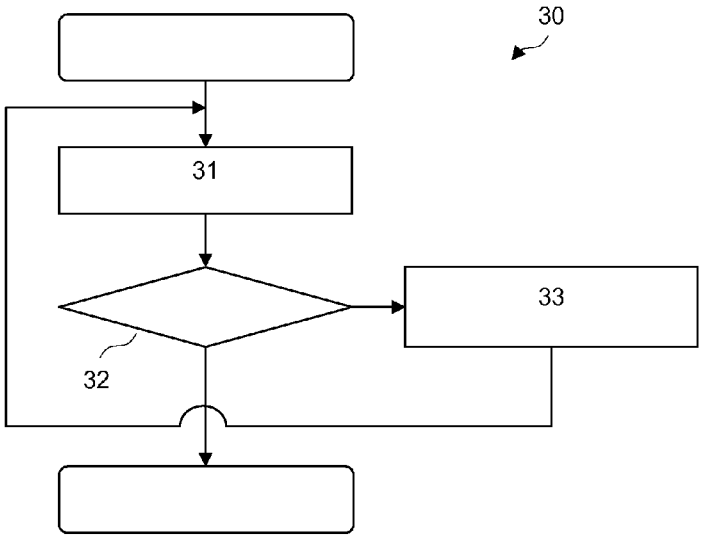
FIG. 3 shows a flow diagram illustrating features of embodiments of the invention.

In this regard, FIG. 3 shows a flow diagram to illustrate features of embodiments of the present invention. Accordingly, when control program 30 is executed by a processing unit in the form of or similar to a microprocessor, ASICs, or the like, drive unit controller 21 first determines a measure of a volume flow rate generated by vacuum cleaner 1 during operation and/or a measure of the volume flow rate generated by vacuum cleaner 1 during operation on the one hand, as well as a measure of a negative pressure generated by vacuum cleaner 1 during operation on the other hand, and generates, from the volume flow rate and the negative pressure, an operand as a measure of a suction power (first function block 31). Then, in a second function block 32, the determined volume flow rate is compared to a predefined or predefinable upper flow rate limit and/or the operand is compared to the threshold predefined or predefinable as a design limit. Depending on the result of the comparison, in particular, depending on the results of both comparisons, the electrical power input to the drive unit may then be reduced by suitably driving inverter 16 (third function block 33). Then, the control program is cyclically continued by executing function block 31 again, unless the execution of the control program is terminated.

Figure 4:
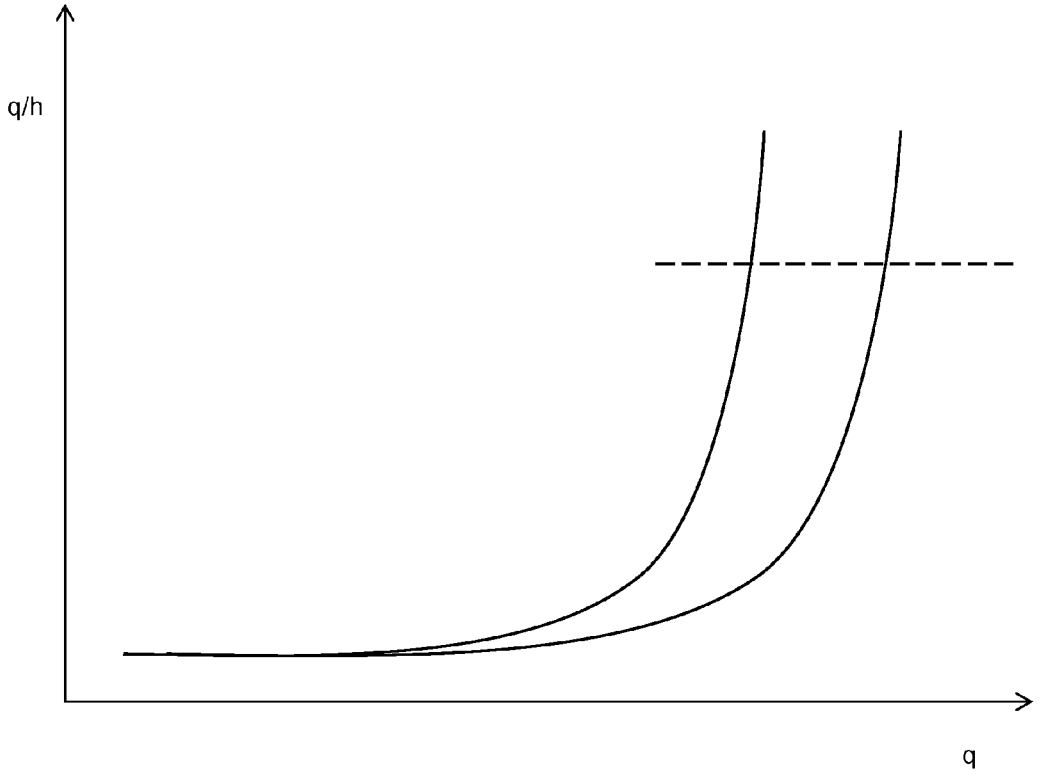
FIG. 4 shows the variation with time of the operand.

FIG. 4 shows the variation with time of the operand. In particular, the first, left curve is shown for a full or at least partially filled dust bag, while the right curve is shown for an empty dust bag. The curves are plotted against a respective volume flow rate on the abscissa and a ratio of the volume flow rate and the negative pressure on the ordinate. It can be seen that with increasing measured flow rate values, both curves rise sharply; i.e., regardless of the filling level of the dust bag. Therefore, the design limit can be drawn as a horizontal line (shown dashed in FIG. 4), and the same numerical value of the design limit can be used for conditions where the dust bag is empty, partially filled, or full.

Figure 5:
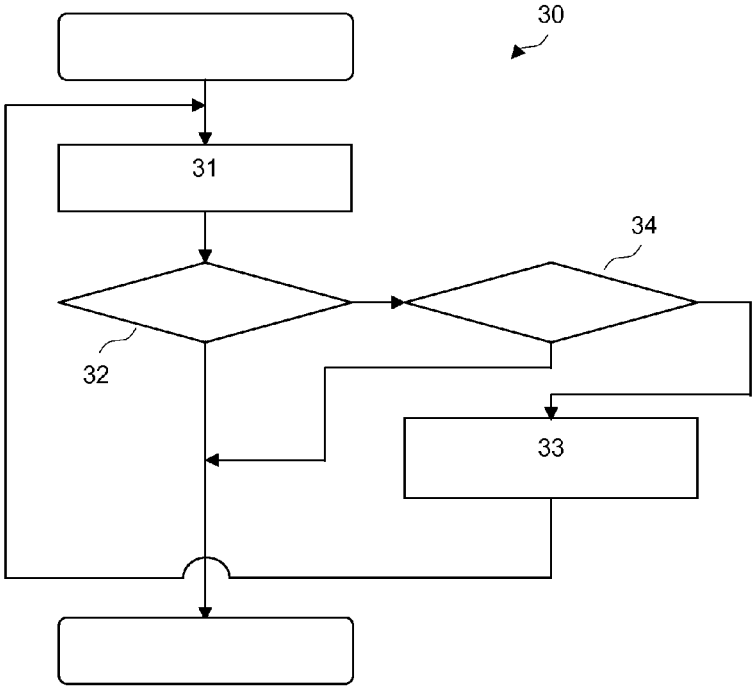
FIG. 5 shows an embodiment of a control program based on FIG. 3.

Based on the flow diagram of FIG. 3, FIG. 5 shows a particular embodiment of control program 30, where in an inserted fourth function block 34, a check is made as to whether the measured volume flow rate exceeds the upper flow rate limit for longer than a duration determined by a predefined or predefinable time limit, and the reduction of the power input through the execution of third function block 33 occurs only if the time limit is reached or exceeded.

The fundamentals of the approach of the present invention mentioned in the general description section may be implemented in software with a correspondingly enhanced control program 30 on the basis of the principle shown in FIG. 3 and FIG. 5 with suitable function blocks and their implementation.

Based on the measure of the volume flow rate determined during operation on the one hand and on the determined measure of the negative pressure on the other hand, an operand is generated, for example, in first function block 31, which operand may be, for example, a ratio between the volume flow rate and the negative pressure. In a manner similar to that described above, this quantity can be compared, for example, in second function block 32, to a threshold predefined or predefinable as a design limit. Depending on the result of the comparison, the power input to the drive unit may then be reduced. This can be accomplished in that inverter 16 (FIG. 3, FIG. 5, function block 33) is driven directly, or in that a result of the by the fourth function block 34 (checking the duration of exceedance of the upper flow rate limit) is combined, for example, by a logical AND operation, with the comparison of the operand to the design limit, and, accordingly, third function block 33 is executed only if both conditions are met.

Figure 6:
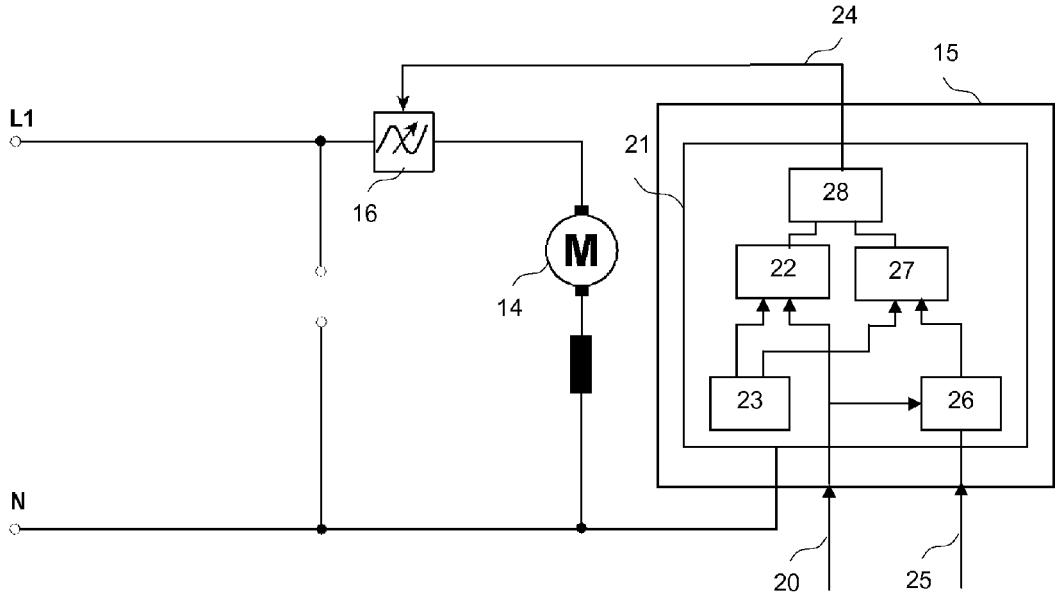
FIG. 6 illustrates an embodiment of a drive unit controller based on the condition shown earlier in FIG. 2.

In this regard, FIG. 6 illustrates an embodiment of drive unit controller 21 based on the condition shown earlier in FIG. 2. Here, in order to generate the operand, a measured negative pressure value 25 is processed in addition to measured flow rate value 20, namely in the form of a quantity calculated from measured flow rate value 20 and measured negative pressure value 25 (ratio of measured flow rate value 20 to measured negative pressure value 25), for example, in the form of a quotient of measured flow rate value 20 and measured negative pressure value 25. The operand may in principle be generated in any desired form. What is important here is first and foremost sufficient steepness in the variations of measured flow rate value 20 (see FIG. 4). Thus, the respective numerical value of the operand may be the result of a mathematical relation, for example, as a quotient of measured flow rate value 20 and measured negative pressure value 25, or as a quotient of the square or higher powers of measured flow rate value 20 and measured negative pressure value 25, such as, for example, q^n/h^n, q^n/h, etc., or the result of an algorithm or the like. A functional unit 26 is provided for generating the operand, in particular, the quotient. The operand is then compared by a comparator 27 to a threshold which is predefined or predefinable as a design limit and is stored, for example, in memory 23 and retrievable therefrom. The output signals of the two comparators 22, 27 are logically combined in a suitable way by a combinational logic unit 28, such as an AND gate. As a result of this combination, depending on the type of combination and the input signals to combinational logic unit 28, a signal for driving inverter 16 is generated via activatable signal output 24.

Thus, activatable signal output 24 can be activated depending on the result of the comparison of the determined duration and the time limit (comparator 22, combinational logic unit 28), as well as depending on the result of the comparison of the operand to the design limit (functional unit 26, comparator 27, combinational logic unit 28). If, as proposed herein, both conditions implemented by comparators 22, 27 must be met in order to reduce the electrical power input to the drive unit, then combinational logic unit 28 is an AND gate or a functionally equivalent unit. If only one of the conditions needs to be met, then combinational logic unit 28 is correspondingly an OR gate. If only the operand and the design limit are to be used for activating activatable signal output 24, then the branch containing comparator 22 and combinational logic unit 28 may optionally be omitted and the output of comparator 27 may be fed directly to activatable signal output 24. However, consideration of both conditions has the advantage that the operand needs to be generated only when a potential condition of non-use is recognizable based on a measured flow rate value exceeding the upper flow rate limit, so that during normal operation, it is sufficient to monitor the measured flow rate value with regard to the upper flow rate limit, and the operand is generated only when the upper flow rate limit is reached or exceeded. This avoids unnecessary use of resources in terms of processing power and/or memory space.

Figure 7:
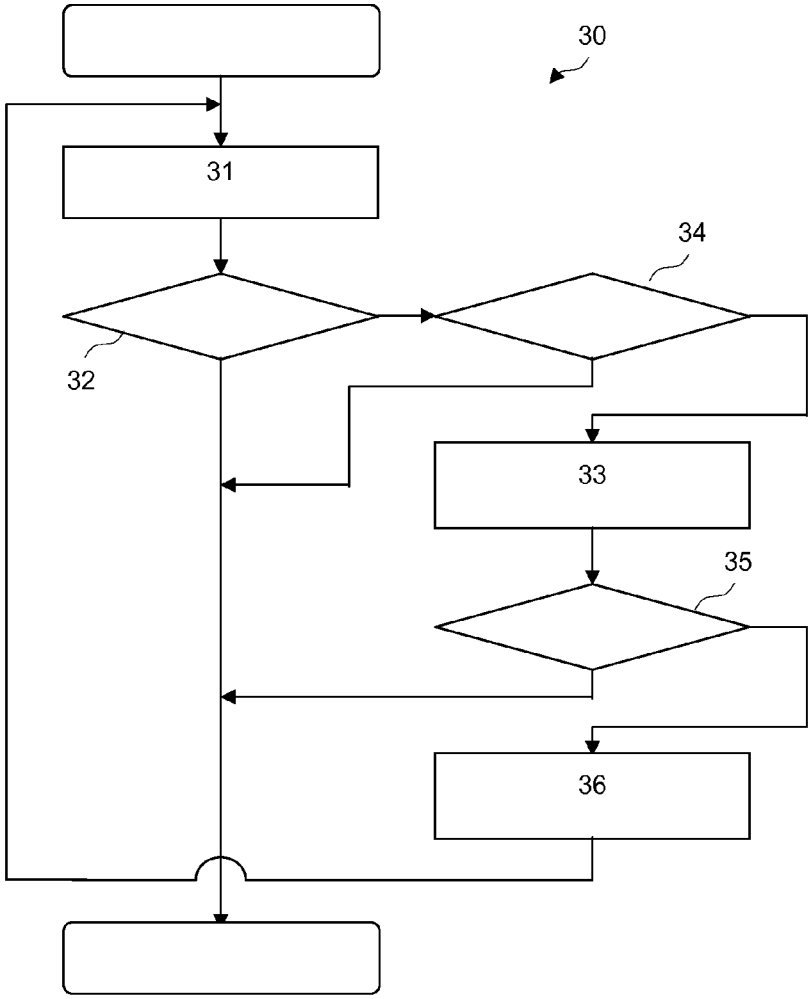
FIG. 7 shows another embodiment of a control program.

FIG. 7 shows a further embodiment of a control program 30. Here, a caused reduction of the power input to the drive unit is detected as a condition of vacuum cleaner 1 in that, during the cyclic execution of control program 30 and as long as the conditions expressed by function blocks 32, 34 are met, the program always branches to third function block 33, and thus, inverter 16 continues to be driven to reduce the power input. The detection of such a condition may also be accomplished in other ways, for example, by setting a corresponding flag in control program 30, and polling it elsewhere. Here, after third function block 33 is executed; i.e., during the condition of reduced power input, it is checked in a fifth function block 35 whether there is an increase in the volume flow rate and/or an increase in the negative pressure and, depending on the result of this check, a sixth function block 36 may be called to cancel the reduction of the electrical power input to the drive unit.

Figure 2:
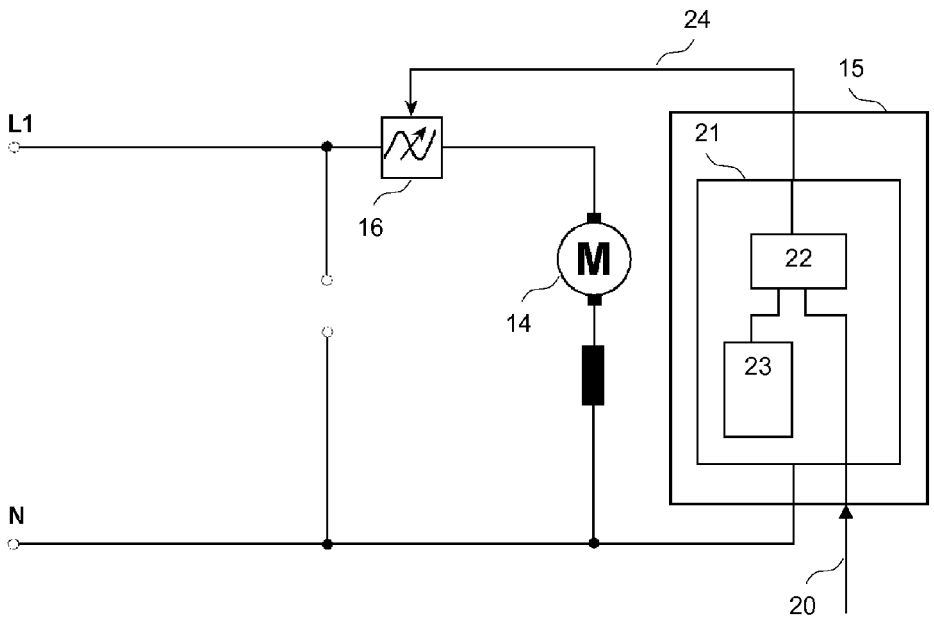
FIG. 2 depicts a drive unit controller as a means for implementing an approach described herein.

In a specific embodiment, provision may be made in connection with the cancellation of the reduction of the electrical power input to the drive unit to energize the drive unit, at least briefly, with a particular maximum allowable motor voltage. It may also be provided that the duration of the brief energization of the drive unit with the respective maximum allowable motor voltage is a function of a power setting selected for the drive unit. To this end, a so-called lookup table (LUT) containing a time value for each possible power setting or for each of a plurality of power setting ranges may be stored, for example, in memory 23 (FIG. 2, FIG. 6). Upon activation of the drive unit, this time value is read from the memory 23/from the LUT and used for monitoring the duration of activation of the drive unit.

Figure 8:
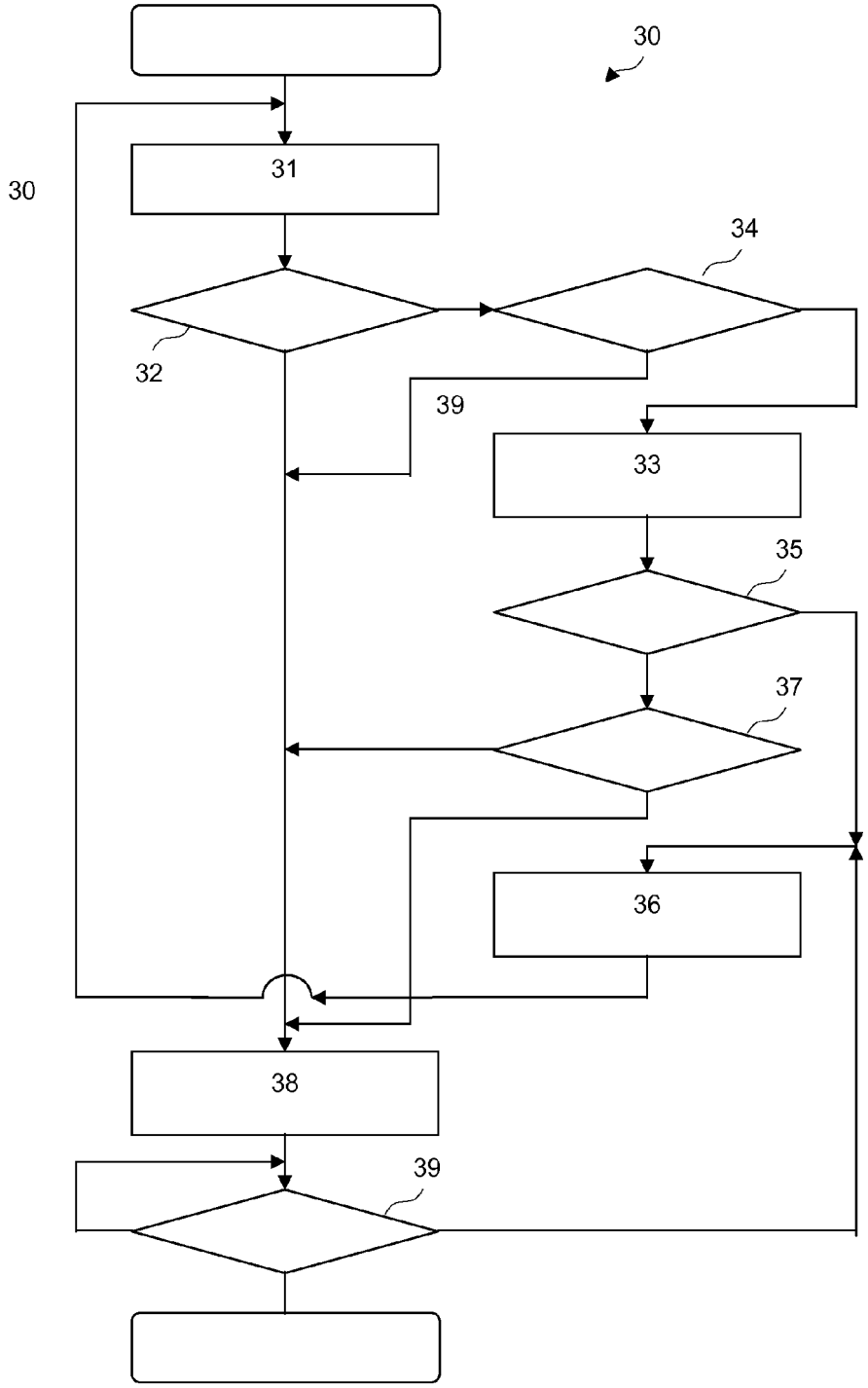
FIG. 8 shows a flow diagram of a method in accordance with an embodiment of the invention.

Finally, FIG. 8 shows a flow diagram for an embodiment of the method or a drive unit controller operating according to this method based on the diagram of FIG. 7. In a seventh function block 37, a check is made as to whether the condition of the reduction of the electrical power input has existed for longer than a time period determined by a predefined or predefinable time limit stored, for example, in memory 23. If this is the case, the drive unit is deactivated and the program branches to an eighth function block 38, which deactivates the drive unit. Eighth function block 38 may be followed by a ninth function block 39, which is used to monitor, for example, a user action, such as moving the floor nozzle or pressing a button of control and display unit 17. When such a user action is detected, the program branches to sixth function block 36 and the drive unit is activated again. If no provision is made for such monitoring for a user action, a drive unit that was automatically completely turned off can always be activated again by switching vacuum cleaner 1 on and off again or, depending on how the automatic deactivation is implemented, by switching it on again using its ON/OFF switch, as a result of which control program 30 is restarted with newly initialized starting values with regard to the determined measured values 20, 25 or the monitored time periods, and thus, the drive unit initially runs in the usual manner until the floor nozzle or the suction wand happens to be taken off the floor and the here described automatic stop function or automatic start/stop function steps in to influence the activation state of the drive unit in order to avoid unnecessary energy consumption.

In principle, it is also conceivable for the automatic stop function or the automatic start/stop function to be able to be calibrated by the user or manufacturer of the vacuum cleaner or by service personnel. To this end, a calibration mode provided for calibration purposes would be activated on the vacuum cleaner, for example, by actuating a corresponding switch element or by actuating an already existing switch element for longer than a predefined time period. The drive unit controller indicates the start of the calibration by means of a signal emitted by the vacuum cleaner, such as, for example, a flashing indicator. The floor nozzle is then lifted and held in the lifted position for at least two seconds, for example. After a predetermined time period of, for example, two seconds, the drive unit controller determines measured flow rate value 20 and measured negative pressure value 25. The two measured values are buffered. After the determination of these measured values is complete, the vacuum cleaner indicates the start of a second part of the calibration. Upon such a signal, the floor nozzle is put down and held in the put-down position for at least two seconds, for example. After a predetermined time period of, for example, two seconds, the drive unit controller once more determines measured flow rate value 20 and measured negative pressure value 25. These two measured values are also buffered. A new value for the upper flow rate limit can be derived directly from the two buffered measured values of the volume flow rate, for example, as a mean between the two measured values. The new upper flow rate limit is stored in the memory, for example, a non-volatile memory of the drive unit controller. In the same or a similar way, the buffered pairs of measured values of the volume flow rate and negative pressure may be used to calculate respective values for a design limit, and the new design limit may then also be obtained, for example, as a mean between the two previously calculated values. The new design limit is also stored in the memory, for example, a non-volatile memory of the drive unit controller. There, the new upper flow rate limit and/or the new design limit is/are then available as limit values which were calibrated or updated in a device-specific manner. Such a calibration helps in identifying aging effects and resulting changes in the negative pressure and the volume flow rate that are attainable during operation, and in adjusting the switching conditions for activating the automatic stop or start/stop function. In addition, such a calibration also allows the switching conditions to be adapted to different floor nozzles.

Thus, various salient aspects of the approach described herein can be briefly summarized as follows: Disclosed is a vacuum cleaner 1 having a drive unit and a drive unit controller 21, and a method for operating such a vacuum cleaner 1, said drive unit, when energized, generating a volume flow rate and a negative pressure during the operation of vacuum cleaner 1. Vacuum cleaner 1 and drive unit controller 21 are characterized in that vacuum cleaner 1 includes means for determining a measure of the volume flow rate generated during operation and a measure of the negative pressure generated during operation, and that drive unit controller 21 includes means 22 for comparing the determined volume flow rate and a predefined or predefinable upper flow rate limit and/or means 27 for comparing an operand generated from the determined volume flow rate and the determined negative pressure to a threshold predefined or predefinable as a design limit, and further includes or controls means 16, 24 for reducing the electrical power input depending on the result of the comparison or the results of both comparisons. Alternatively, or in addition, such monitoring may be performed analogously with respect to a negative pressure generated during operation and a lower limit for the negative pressure. With that, an automatic stop function or, in refined embodiments, even an automatic start/stop function is implemented. The function that enables the drive unit to be automatically turned off and possibly on again may be implemented as a permanently active function or as a user-activatable function. In the case of a permanently active function, provision may be made for the function to be deactivatable by the user.

While the invention has been particularly shown and described with reference to preferred embodiments thereof, it will be understood by those skilled in the art that various changes in form and details may be made therein without departing from the spirit and scope of the invention.

LIST OF REFERENCE NUMERALS

1 vacuum cleaner
2 suction fan
3 housing
4 fan chamber
5 dust collection chamber
6 suction hose
7 suction wand
8 floor nozzle
9 dirt

10 arrow (representing dirt-laden air)
11 dust bag
12 motor filter
13 exhaust filter unit
14 fan motor
15 control unit
16 inverter
17 control and display unit
20 measured flow rate value
21 drive unit controller
22 comparator
23 memory
24 signal output
25 measured negative pressure value
26 functional unit
27 comparator
28 combinational logic unit
30 control program
39-39 (first, second, . . . ninth) function block

What is claimed is:

1. A vacuum cleaner comprising:

a drive unit configured to generate a volume flow rate and a negative pressure, when energized, during operation of the vacuum cleaner;

a means for determining a measure of the volume flow rate generated during operation;

a pressure sensor for determining a measure of the negative pressure generated during operation;

a drive unit controller configured to generate an operand from the measure of the determined volume flow rate and the measure of the determined negative pressure, and configured to compare the operand with a predefinable threshold as a design limit, the drive unit controller being operable to reduce an electrical power input to the drive unit based on the comparison of the operand to the design limit.

2. The vacuum cleaner recited in claim 1, wherein the drive unit controller is configured to compare the measure of the determined volume flow rate to a predefinable upper flow rate limit and to reduce the electrical power input to the drive unit based on both a result of the comparison of the volume flow rate to the upper flow rate limit and the comparison of the operand to the design limit.

3. The vacuum cleaner recited in claim 2, wherein the drive unit controller is configured to determine a duration during which the determined volume flow rate exceeds the upper flow rate limit and to compare the duration of the exceedance to a predefinable time limit, and to generate a signal output based on the result of the comparison of the determined duration and the time limit so as to reduce the electrical power input.

4. The vacuum cleaner recited in claim 3, further comprising a combinational logic unit configured to combine a result of the comparison of the determined duration and the time limit, to combine a result of the comparison of the operand and the design limit, and to produce an output representing an activatable signal output.

5. The vacuum cleaner recited in claim 1, wherein the drive unit controller includes a memory and a microprocessor, the memory including machine-readable instructions executable by the microprocessor, the instructions including:

determining the measure of the volume flow rate generated by the drive unit during operation of the vacuum cleaner;

determining the measure of the negative pressure generated by the drive unit during operation of the vacuum cleaner;

generating the operand from the volume flow rate and the negative pressure;

comparing the operand to the design limit; and reducing the electrical power input to the drive unit based on the comparison.

* * * * *